US006462474B1

(12) United States Patent
Symons

(10) Patent No.: US 6,462,474 B1
(45) Date of Patent: Oct. 8, 2002

(54) GROOVED MULTI-STAGE DEPRESSED COLLECTOR FOR SECONDARY ELECTRON SUPPRESSION

(75) Inventor: Robert Spencer Symons, Los Altos, CA (US)

(73) Assignee: Northrop Grumman Corp., Woodland Hills, CA (US)

( * ) Notice: Subject to any disclaimer, the term of this patent is extended or adjusted under 35 U.S.C. 154(b) by 0 days.

(21) Appl. No.: 09/533,896

(22) Filed: Mar. 21, 2000

(51) Int. Cl.[7] ..... H01J 23/16; H01J 23/27; H01J 23/10

(52) U.S. Cl. ..... 315/3; 330/43; 315/5.38

(58) Field of Search ..... 315/3, 4, 3.5, 5.38, 315/5.39, 160, 224, 291, 241; 330/43, 44, 45

(56) References Cited

U.S. PATENT DOCUMENTS

| | | | | |
|---|---|---|---|---|
| 4,890,036 A | * | 12/1989 | Kosmahl | 315/3 |
| 5,283,534 A | | 2/1994 | Bohlen et al. | 330/45 |
| 5,334,909 A | | 8/1994 | Kawai | 315/5.38 |
| 5,420,478 A | * | 5/1995 | Scheitrum | 315/5.31 |
| 5,440,202 A | * | 8/1995 | Mathews et al. | 315/3 |
| 5,568,014 A | * | 10/1996 | Aoki et al. | 315/3.5 |
| 5,780,970 A | * | 7/1998 | Singh et al. | 315/5.38 |
| 6,084,353 A | * | 7/2000 | Bohlen | 315/5.32 |
| 6,262,536 B1 | * | 7/2001 | Symons | 315/3 |

* cited by examiner

*Primary Examiner*—Don Wong
*Assistant Examiner*—Chuc Tran
(74) *Attorney, Agent, or Firm*—O'Melveny & Myers LLP

(57) ABSTRACT

A linear beam device comprises a cathode and an anode spaced therefrom, with the anode and cathode being operable to form and accelerate an electron beam. An RF interaction region having a drift tube is arranged relative to the anode to permit the electron beam to pass therethrough. A multi-stage depressed collector of the linear beam device has a plurality of collector electrodes successively arranged to collect spent electrons of the electron beam after passing through the RF interaction region. Each one of the plurality of collector electrodes has a distinct voltage level applied thereto defining a decelerating electric field within the collector. At least one of the plurality of collector electrodes further comprises a collecting surface having a shape that is normal to a coincident trajectory of the spent electrons, whereby a substantial portion of the collecting surface is covered with a plurality of narrow grooves. In an embodiment of the invention, the grooved collector electrode further comprises the final electrode of the collector. The final electrode has a surface that is substantially spherical, and the plurality of grooves may be arranged in a concentric pattern of circles on the electrode surface. The plurality of grooves may be formed to a depth that is approximately twice a corresponding width. A region adjacent to an opening of each of the plurality of grooves comprises electric fields defining a convergent lens, thereby focusing the spent electrons into the plurality of grooves.

27 Claims, 5 Drawing Sheets

FIG. 2
PRIOR ART
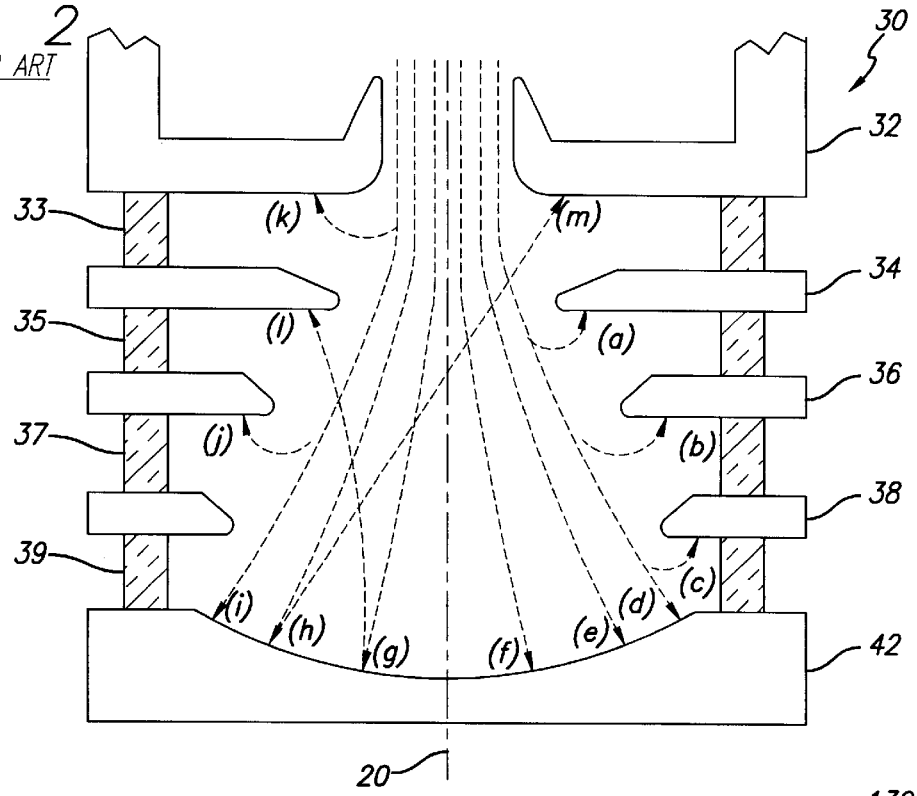
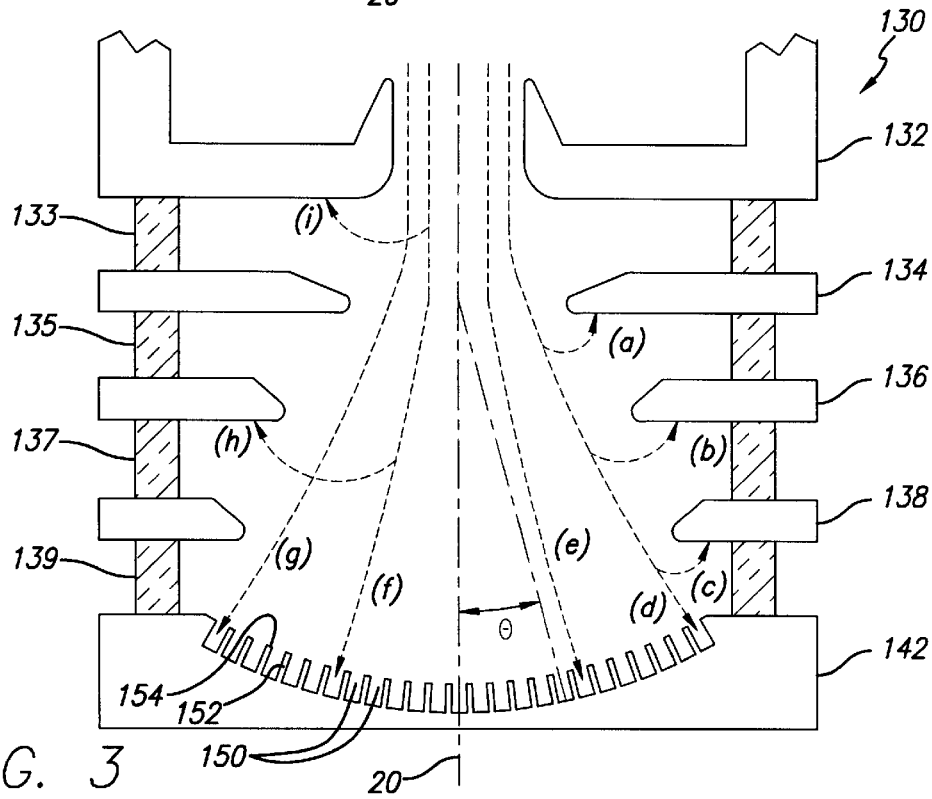
FIG. 3

GROOVED MULTI-STAGE DEPRESSED COLLECTOR FOR SECONDARY ELECTRON SUPPRESSION

BACKGROUND OF THE INVENTION

1. Field of the Invention

The present invention relates to linear beam devices having multi-stage depressed collectors, and more particularly, the invention relates to a multi-stage depressed collector having grooved surfaces in order to suppress generation of secondary electrons.

2. Description of Related Art

Linear beam electron devices are used in sophisticated communication and radar systems to convert direct current (DC) power into radio frequency (RF) power. Conventional klystrons, traveling wave tubes and inductive output tubes are examples of such linear beam electron devices. In a linear beam device, an electron. beam originating from an electron gun having a cathode is accelerated by a DC voltage differential with an anode spaced from the cathode. The accelerated electron beam passes through a drift tube containing an RF interaction structure. The electron beam may become amplitude modulated by applying an RF input signal to a grid disposed between the anode and cathode. Alternatively, the RF interaction structure of the drift tube may further include an RF circuit used to induce a modulation on the electron beam. Either way, the modulation results in electron concentration or bunching due to electrons that have had their velocity increased gradually overtaking those that have been slowed. The accelerated electrons of the electron beam give up varying amounts of their energy to the RF electric fields of traveling or standing wave circuits of the RF interaction structure. The energy removed from the electron beam in this manner may be subsequently removed from the device in the form of an amplified RF signal.

It has long been desirable to increase the efficiency of linear beam electron devices. If it were possible to make the length of the electron bunches infinitesimal and the amplitude infinite so that the average electron current remained finite, then one could apply an RF decelerating field to the bunch that would stop all the electrons and yield a device that is 100% efficient. In actual practice, when a sinusoidally time varying RF electric field exists on or in an output circuit of a linear beam device and the time length of the electron bunch is finite, some of the electrons will necessarily pass through the output circuit at times when the decelerating force of the RF electric field is less than maximum. As a result, many of the electrons will give up less than all of their energy, and the efficiency of the tube will be reduced accordingly.

A known technique for recovering the energy of the electrons that emerge from the output circuit (referred to as the "spent beam" or "spent electrons") and thereby increase the efficiency of a linear beam device is to use a multi-stage depressed collector. A multi-stage depressed collector includes plural collector electrodes having successively decreasing voltage potentials in order to define a steady (i.e., not time varying) decelerating electric field. The collector electrodes further include holes aligned with the electron beam axis providing a path for the spent electrons to penetrate into the collector. The decelerating electric field slows the spent electrons as they penetrate into the collector to thereby allow their collection on one of the collector electrodes. The movement of the spent electrons within the collector is analogous to the way balls of varying velocity might roll up a hill, then stop and reverse direction after converting all of their kinetic energy to potential energy. If an electron has a little momentum transverse to the electric field when they reverse direction, the electron is likely to be collected by one of the electrodes that has less than the maximum potential and some of the energy of the spent beam will therefore be recovered. Unlike balls, electrons exhibit mutual repulsion due to their similar charge (i.e., negative) to thereby provide the transverse momentum.

Multi-stage depressed collectors are generally constructed such that most of the spent electrons will strike the back side of each of the collector electrodes (i.e., the side facing away from the output circuit), with the exception of the final collector electrode. This is advantageous since it tends to minimize the adverse effects of secondary electron emissions from the electrodes. A secondary electron emission refers to electrons that are knocked out the metal material of the collector electrodes by the impact of an energetic electron. These secondary electrons can actually become accelerated by the electric fields in the collector in a direction opposite the flow of the electron beam back into the linear beam device. By configuring the collector such that electrons typically strike the back side of a collector electrode, the electric fields operative on any secondary electrons that are emitted generally cause the secondary electrons to simply return to the electrode.

The shape of the final collector electrode remains problematic in terms of its generation of secondary emissions. Because an electron can only give up kinetic energy to the component of the electric field that is parallel to its direction of motion, it is desirable to configure the surface of the final collector electrode to be normal to the incoming electron trajectories. This shape also tends to cause secondary electrons to be accelerated back to higher potential electrodes and thereby waste power that is dissipated when the secondary electrons strike the higher potential electrodes. It is also known to configure the final collector electrode as a deep "bucket," sometimes having a spike extending along the beam axis to shape the electric fields at the back of the collector to disperse high-energy electrons. A drawback of this design approach is that equipotential electric field lines at the mouth of the bucket are rarely perpendicular to the electron trajectories. Electrons that strike the surface of the bucket or the spike will usually have a great deal of energy in momentum that is directed parallel to these surfaces that cannot be recovered.

Accordingly, it would be desirable to provide a multi-stage depressed collector for a linear beam device having an electrode shape that minimizes secondary emissions while otherwise promoting efficient electron collection.

SUMMARY OF THE INVENTION

The present invention is directed to a multi-stage depressed collector for use in a linear beam device having a plurality of grooves formed in the collecting surface of at least one of the collector electrodes. The grooves provide a substantially field-free region that tends to prevent any secondary electrons generated by electrons that impact the grooves from exiting the grooves. Moreover, the grooves distort the electric field lines closely adjacent to the electrode surfaces to direct electrons into the grooves. As a result, a substantial reduction of secondary emissions are expected with the multistage depressed collector of the present invention, thereby providing a corresponding improvement in collector efficiency.

More particularly, a linear beam device comprises a cathode and an anode spaced therefrom, with the anode and cathode being operable to form and accelerate an electron beam. An RF interaction region having a drift tube is arranged relative to the anode to permit the electron beam to pass therethrough. A multi-stage depressed collector of the linear beam device has a plurality of collector electrodes successively arranged to collect spent electrons of the electron beam after passing through the RF interaction region. Each one of the plurality of collector electrodes has a distinct voltage level applied thereto defining a decelerating electric field within the collector. At least one of the plurality of collector electrodes further comprises a collecting surface having a shape that is normal to a coincident trajectory of the spent electrons, whereby a substantial portion of the collecting surface is covered with a plurality of narrow grooves.

In an embodiment of the invention, the grooved collector electrode further comprises the final electrode of the collector. The final electrode has a surface that is substantially spherical, and the plurality of grooves may be arranged in a concentric pattern of circles on the electrode surface. The plurality of grooves may be formed to a depth that is approximately twice a corresponding width. A region adjacent to an opening of each of the plurality of grooves comprises electric fields defining a convergent lens, thereby focusing the spent electrons into the plurality of grooves.

In another embodiment of the invention, the grooved collector electrode further comprises an intermediate electrode other than the final electrode of the collector. The plurality of grooves are disposed on a front side of the intermediate electrode oriented toward the cathode. The plurality of grooves are arranged in a radial pattern by which the grooves are closely spaced at a region of the collector surface adjacent to the central beam hole. Since relatively few of the electrons strike the front side of the intermediate electrode, and the electrons that do strike the front side tend to impact close to the central beam hole, the radial arrangement of grooves will substantially reduce secondary emission even though a large percentage of the overall surface of the electrode is not covered by grooves.

A more complete understanding of the grooved multi-stage depressed collector for secondary electron suppression will be afforded to those skilled in the art, as well as a realization of additional advantages and objects thereof, by a consideration of the following detailed description of the preferred embodiment. Reference will be made to the appended sheets of drawings which will first be described briefly.

BRIEF DESCRIPTION OF THE DRAWINGS

FIG. 2 is a side sectional view of a prior art multi-stage depressed collector showing secondary emission from a final electrode;

FIG. 3 is a side sectional view of a multi-stage depressed collector in accordance with an embodiment of the present invention;

DETAILED DESCRIPTION OF THE PREFERRED EMBODIMENT

The present invention satisfies the need for a multi-stage depressed collector for a linear beam device having an electrode shape that minimizes secondary emissions while promoting efficient electron collection. In the detailed description that follows, like element numerals are used to describe like elements illustrated in one or more of the figures.

Figure 1:
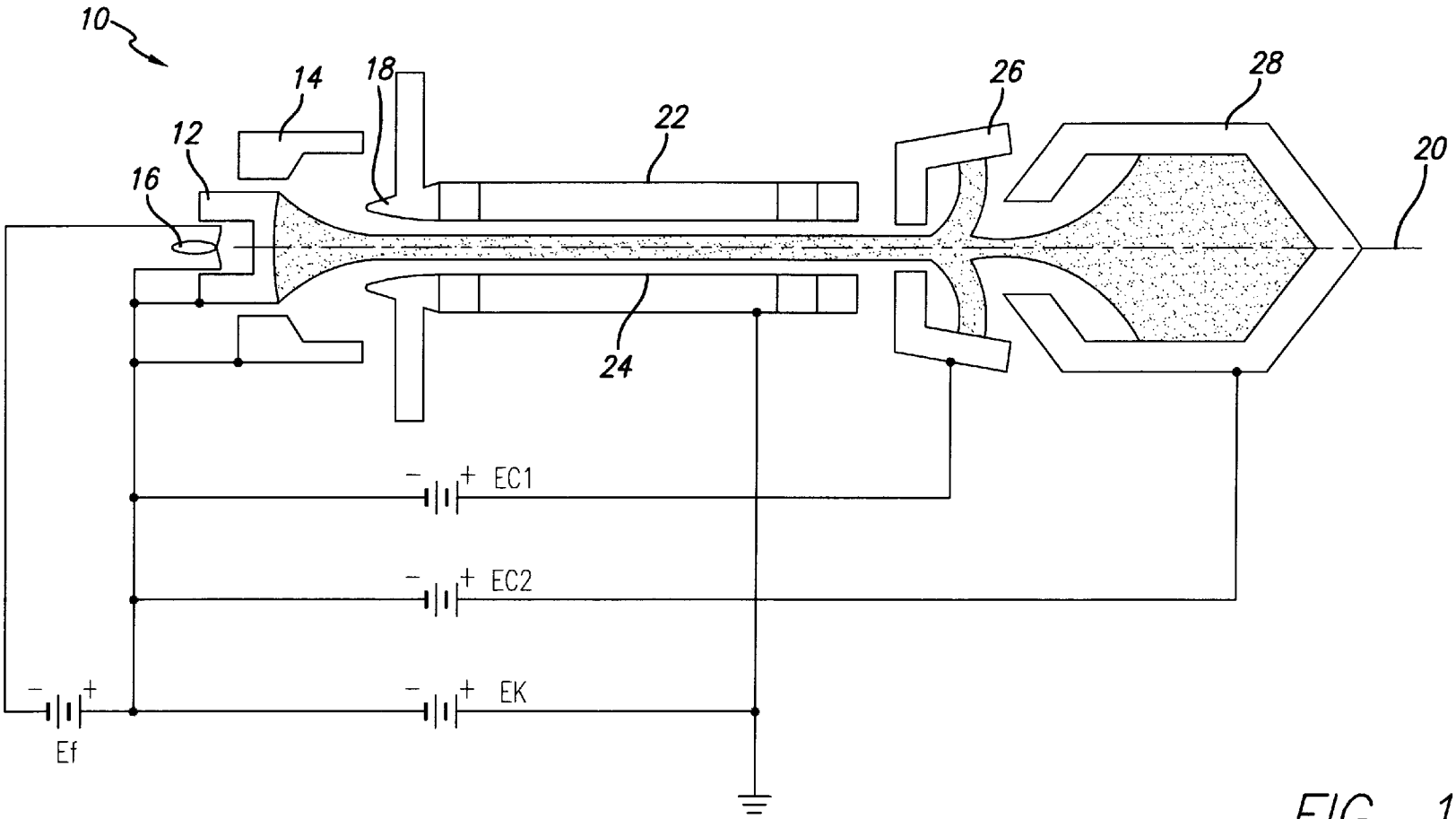
FIG. 1 PRIOR ART
FIG. 1 is a side cross-sectional view of a prior art linear beam device.

Referring first to FIG. 1, a prior art linear beam device 10 is illustrated. The linear beam device 10 includes a cathode 12 having a concave electron emitting surface and a heater filament 16 embedded within the cathode body. A focusing electrode 14 is disposed concentrically around the cathode 12. An anode 18 is spaced from the cathode and forms a portion of an RF interaction region 22. An axial beam tunnel 24 extends through the RF interaction region 22. A filament voltage source $E_F$ is coupled across the heater filament 16 causing the cathode temperature to rise to a level sufficient to permit thermionic emission of electrons from the cathode emitting surface. A cathode voltage source $E_K$ is coupled between the cathode 12 and the anode 18 in order to define a highly negative voltage therebetween that is sufficient to draw and accelerate the emitted electrons into a beam. One or more grids may also be disposed between the cathode 12 and anode 18 in order to density modulate the electron beam. The electron beam extends coaxially along a central axis 20 of the device 10. The device 10 may further include a magnetic field defined within the interaction region 22 that confines the electron beam within the beam tunnel 24. The RF interaction region 22 may further include resonant characteristics, such as a slow wave structure, helix, resonant cavities, coupled cavities, and the like, in which the electron beam gives up energy to an RF current that is extracted from the device. Examples of known linear beam devices includes klystrons, traveling wave tubes, inductive output tubes, and other hybrid devices.

After passing through the RF interaction region 22, the spent electron beam passes into a multi-stage collector including a first collector electrode 26 and a second collector electrode 28. A first collector electrode voltage supply $E_{C1}$ is coupled between the first collector electrode 26 and the cathode 12 in order to define a first voltage therebetween, and a second collector electrode voltage supply $E_{C2}$ is coupled between the second collector electrode 28 and the cathode 12 in order to define a second voltage therebetween. It should be appreciated that a greater number of collector electrodes and corresponding voltage supplies could be-advantageously utilized. The voltages applied to the collector electrodes 26, 28 define a decelerating electric field within the collector that decelerates the spent electrons, causing them to be collected on one of the electrodes, thereby returning energy to the voltage supplies.

FIG. 2 illustrates an exemplary prior art multi-stage depressed collector 30 in greater detail. The multi-stage depressed collector 30 comprises five successive collector electrode stages, including a first electrode 32, a second electrode 34, a third electrode 36, a fourth electrode 38 and a fifth electrode 42. The electrode stages are separated by electrically insulating cylinders 33, 35, 37 and 39, respectively. The first electrode 32 may actually be provided by an end portion of the RF interaction region (see FIG. 1). The first four electrodes 32, 34, 36, 38 have a generally annular shape with a hole aligned to the central axis 20 of the device, thereby permitting the spent electrons of the beam to pass therethrough. The fifth (i.e., final) electrode 42 comprises a generally spherical surface that encloses the back end of the collector 30, though other shapes for the electrode surface such as parabolic, hyperbolic or planar may be selected depending upon the electric field characteristics of the collector so that the surface is normal to the trajectories of incoming spent electrons. The collector electrodes are generally comprised of an electrically and thermally conductive metal material, such as copper, and are each coupled to respective voltage supplies as described above with respect to FIG. 1.

The exemplary trajectories of various ones of the spent electrons of the beam are further shown in FIG. 1. Electron trajectory (k) depicts an electron that passes through the hole in the first electrode 32, and then reverses direction and collides into the back side of the first electrode. Electron trajectory (a) depicts an electron that passes through the holes in the first and second electrodes 32, 34, and then reverses direction and collides into the back side of the second electrode. Electron trajectories (b) and (j) depict electrons that pass through the holes in the first, second and third electrodes 32, 34, 36, and then reverse direction and collide into the back side of the third electrode. Electron trajectory (c) depicts an electron that passes through the holes in the first, second, third and fourth electrodes 32, 34, 36, 38, and then reverses direction and collides into the back side of the fourth electrode. The electron trajectories of each of the spent electrons tend to diverge as they penetrate into the collector 30 due to the repellent force of their like electrical charge. If any secondary emissions result from the aforementioned impacts between the electrons and the back sides of the electrodes, the secondary electrons would likely return quickly to the same electrode surface due to the decelerating electric field within the collector.

As further shown in FIG. 2, electron trajectories (d), (e), (f), (g), (h) and (i) depict electrons that penetrate all the way to the fifth electrode 42, and secondary emissions are generated from the electrons having trajectories (g) and (h). A secondary electron is accelerated by electric fields within the collector to impact the second electrode 34 with trajectory (l), and another secondary electron is likewise accelerated to impact the first electrode 32 with trajectory (m). As described above, the secondary emissions represent a degradation of efficiency of the multi-stage depressed collector 30. It should be appreciated that the electron trajectories depicted in FIG. 2 are merely illustrative of the paths of spent electrons based on mathematical modeling of the electric fields within the collector 30, and that the actual trajectories of the electrons may be somewhat more complex and/or unpredictable.

Referring now to FIG. 3, an embodiment of a multi-stage depressed collector 130 in accordance with the present invention is shown. As with the prior art collector 30 of FIG. 2, the multi-stage depressed collector 130 comprises five successive collector electrode stages, including first electrode 132, second electrode 134, third electrode 136, fourth electrode 138 and fifth electrode 142. The electrode stages are separated by electrically insulating cylinders 133, 135, 137 and 139, respectively. The first electrode 132 may actually be provided by an end portion of the RF interaction region (see FIG. 1). The first four electrodes 132, 134, 136, 138 have a generally annular shape with a hole aligned to the central axis 20 of the device, thereby permitting the spent electrons of the beam to pass therethrough. The diameters of the electrode holes increase successively with each of the first four electrodes 132, 134, 136, 138 in correspondence with the diverging paths of electrons within the collector 130 due to space charge effects in the absence of a confining magnetic field. The fifth (i.e., final) electrode 142 comprises a generally spherical surface that encloses the back end of the collector 130, though other shapes for the electrode surface such as parabolic, hyperbolic or planar may be selected depending upon the electric field characteristics of the collector so that the surface is normal to the trajectories of incoming spent electrons. The collector electrodes may each be comprised of an electrically and thermally conductive metal material, such as copper, and are each coupled to respective voltage supplies as described above with respect to FIG. 1.

Unlike the prior art collector 30 of FIG. 2, the multi-stage depressed collector 130 of FIG. 3 further comprises a plurality of grooves 150 formed in the surface of the final electrode 142. The walls 152 separating individual grooves 150 have corresponding top surfaces 154. The grooves 150 are generally narrow and deep such that the depth is greater than the corresponding width. In a preferred embodiment of the invention, the depth of the grooves 150 is at least twice the corresponding width of the grooves. The grooves 150 extend in a direction normal to the surface of the final electrode and are thereby aligned with the direction of trajectory of the incoming spent electrons. In view of the spherical shape of the final electrode 142, an angle θ defined between the central axis 20 and the direction of each groove 150 measured in the depth dimension of the groove will increase as the distance from the central axis 20 increases.

Figure 8:
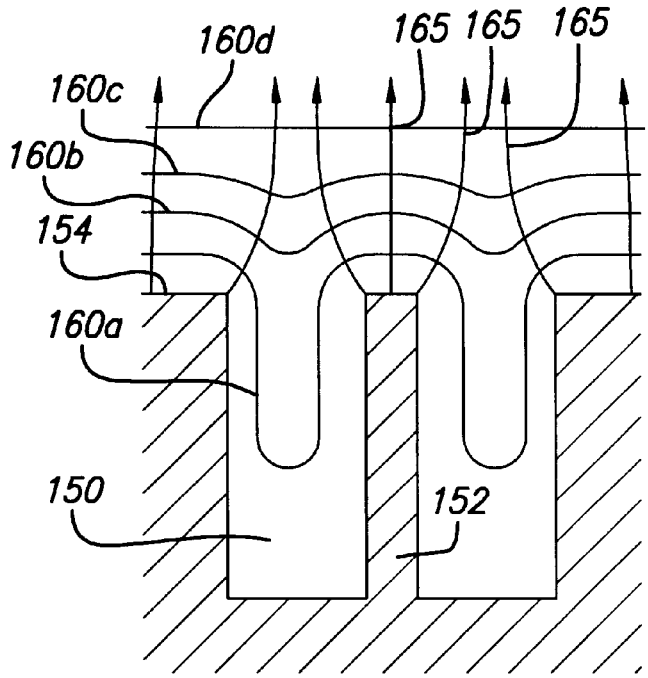
FIG. 8 is an enlarged side sectional view of a grooved final electrode having a rectangular groove shape.

FIG. 8 illustrates an enlarged portion of the final collector electrode of FIG. 3. The grooves 150 are illustrated as having a generally rectangular cross-section. The thickness of the walls 152 between adjacent ones of the grooves 150 is kept to a minimum so that a large portion (i.e., greater than 75%) of the surface of the final electrode is covered by the grooves 150 as opposed to the tops 154 of the walls 152. The equipotential electric field lines adjacent to the openings of the grooves 150 are also shown in FIG. 8. The electric field lines for the collector 130 are substantially the same as in a conventional collector up to a distance very close to the surface of the final electrode. At this close distance to the final electrode, the equipotential-field lines 160*a*, 160*b*, 160*c*, 160*d* are distorted around the openings into the grooves 150 such that a convergent electrostatic lens is define that focuses into each one of the grooves. Corresponding force lines 165 are also shown which represent the direction of force applied by the negative of the electric field upon the electrons. The force lines 165 are normal to the equipotential lines 160. By the time the spent electrons penetrate this far into the collector 130, they have already given up most of their energy. The spent electrons then enter the grooves with very little energy, and any secondary electrons that are produced within the grooves tend to remain in the grooves 150 and are not accelerated back to the other collector electrodes. In this respect, the space defined at the bottom of the grooves 150 provides a substantially electric field free region in the same manner as a conventional deep "bucket" collector.

Since a large proportion of the surface of the final electrode is covered by the grooves 150, it is expected that the secondary emissions will be reduced by at least the same proportion. Moreover, the convergent electron lens formed at the openings to the grooves 150 may actually guide electrons by bending their trajectories into the grooves and electron impacts onto the lands 154 separating the adjacent grooves would reduce accordingly. For this reason, the reduction in secondary emission will likely be greater than the actual proportion of the final electrode 142 covered by the grooves 150, and may be in a range of 80% to 90% reduction of secondary emission.

Figure 9:
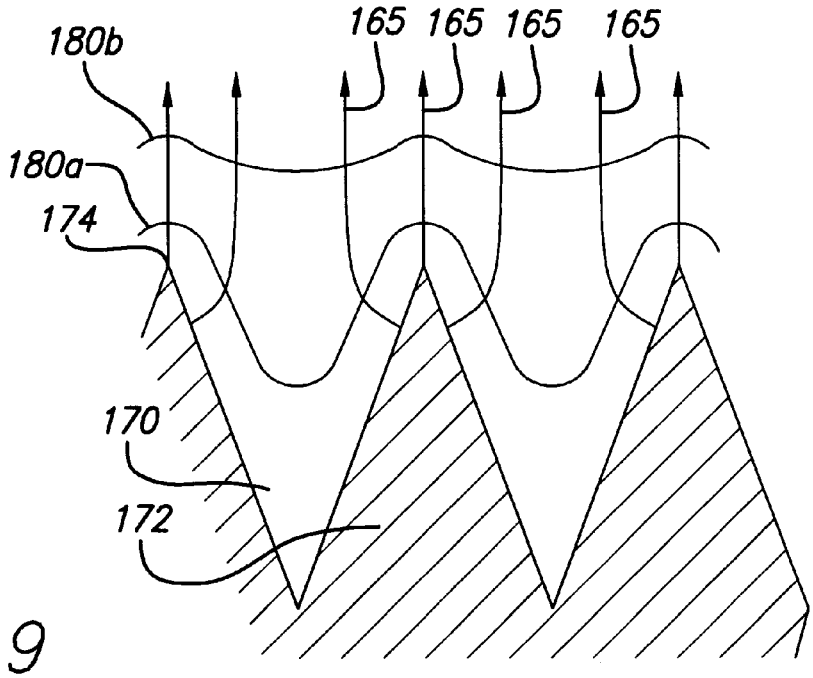
FIG. 9 is an enlarged side sectional view of an alternative grooved final electrode having a triangular groove shape.

FIG. 9 illustrates an enlarged portion of an alternative embodiment of the final collector electrode of FIG. 3, having grooves 170 illustrated as having a generally triangular cross-section. The walls 172 separating individual grooves converge to form an edge 174, which may be sharp, squared or rounded. The converging shape of the walls 172 tends to further increase the portion of the surface of the final electrode covered by the grooves 170. The equipotential field lines 180*a*, 180*b* are distorted around the openings into the grooves 170 in the same general manner as in the foregoing embodiment, and corresponding force lines 165 are also shown which represent the direction of force applied-by the negative of the electric field upon the electrons. It should be appreciated that other cross-sectional shapes of the electrode grooves would also be included within the scope of the present invention, such as semicircular.

Figure 5:
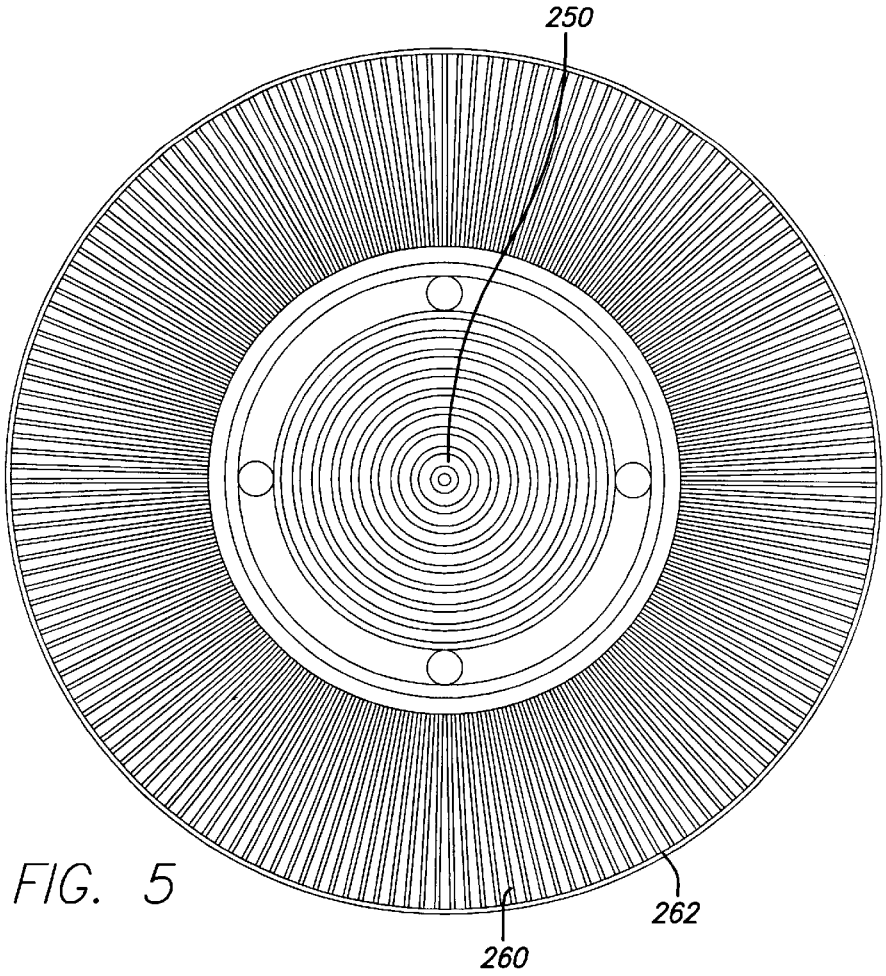
FIG. 5 is an end view of the grooved final electrode of FIG. 4.
Figure 4:
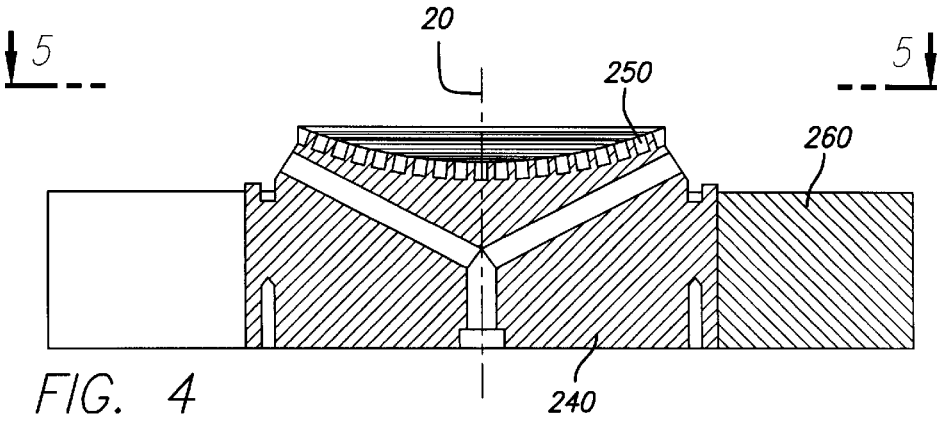
FIG. 4 is a side sectional view of a grooved final electrode in accordance with another embodiment of the invention.

Referring now to FIGS. 4 and 5, a grooved final electrode 240 in accordance with another embodiment of the invention is shown. The final electrode 240 corresponds generally to the final electrode 142 described above with respect to FIG. 3. As in the embodiment of FIG. 3, the final electrode 240 includes a spherical collecting surface covered by a plurality of grooves 250 separated by lands 252. The end view (see FIG. 5) of the surface of the final electrode 240 shows the plurality of grooves 250 as a pattern of concentric circles. It should be appreciated that other patterns, such as a radial or spiral pattern, could also be advantageously utilized. The electrode 240 further includes a plurality of cooling fins 260 that extend radially from the outer perimeter of the electrode collecting surface. The cooling fins 260 are enclosed within a ring 260. It is anticipated that the final electrode 240 be machined from a workpiece of copper material using a turning tool and a lathe, such that the workpiece can be moved at an angle with respect to the lathe rotating the workpiece. This way, the spherical surface can be formed on the electrode 240 and the concentric grooves 250 can be cut into the. spherical surface in a direction normal to the spherical surface. The cooling fins 260 may be thereafter affixed to the machined electrode 240, such as by brazing or soldering.

Figure 7:
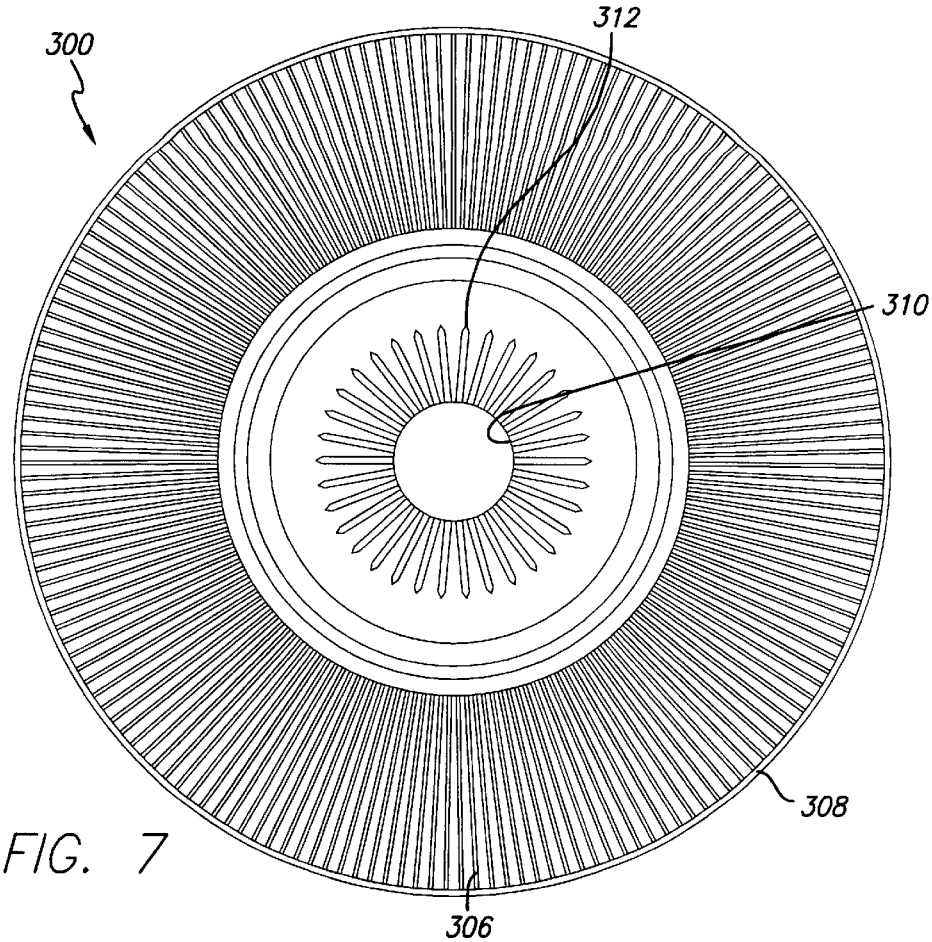
FIG. 7 is an end view of the grooved intermediate collector electrode of FIG. 6.
Figure 6:
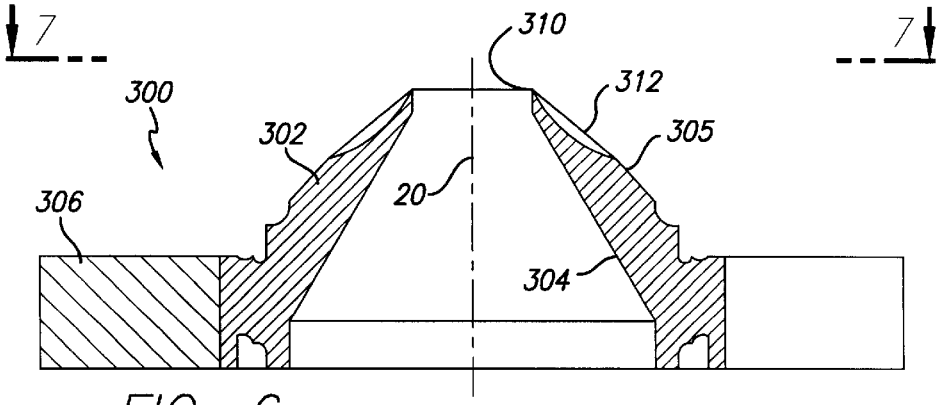
FIG. 6 is a side sectional view of a grooved intermediate collector electrode in accordance with yet another embodiment of the invention.

FIGS. 6 and 7 illustrate an intermediate collector electrode 300 in accordance with yet another embodiment of the invention. The intermediate collector electrode 300 corresponds generally to any one of the electrodes 134, 136, 138 described above with respect to FIG. 3. The electrode 300 includes a generally funnel-shaped body 302 having a trailing surface 304 and a leading surface 305. The shape of the electrode body 302 is determined by the desired electric field characteristics of the collector so that the electric field is normal to the trajectories of incoming spent electrons. The electrode 300 would be oriented with the leading surface 305 facing in a direction toward the cathode of the linear beam device. The electrode 300 further includes a hole 310 aligned to the central axis 20 of the linear beam device. The electrode 300 further includes a plurality of cooling fins 306 that extend radially from the outer perimeter of the electrode body 302. The cooling fins 306 are enclosed-within a ring 308.

As described above, most incoming spent electrons would pass through the hole 310 and impact onto the trailing surface 304 after reversing direction. To minimize secondary emissions from the relatively few electrons that strike the leading surface 305, the leading surface is provided with a plurality of radially extending grooves 312 (see FIG. 7). The grooves 312 function in the same manner as the grooves 150, 250 in the final electrode described above. Particularly, any secondary electrons produced by electrons that enter into the grooves 312 will tend to remain within the grooves. The radial orientation of the grooves 312 provided on the leading surface 305 of the electrode 300 results in the grooves being relatively closely spaced together at the central edge of the electrode close to the hole 310, and the spacing between grooves 312 becomes increasingly greater as, the distance from the hole 310 increases. As a result, the majority of the surface area of the leading surface 305 is not covered by the grooves 312, unlike the final electrodes described above. Since it is anticipated that most electrons that strike the leading surface 305 of the electrode 300 will impact in the region close to the edge of the hole 310, and will rarely strike farther outward on the electrode surface, it is, believed that the high concentration of grooves in the likely impact region will have a sufficiently beneficial effect in reducing most secondary emission from the front side of the electrode. It should also be appreciated that other groove configurations, such as concentric circles, could also be advantageously utilized.

Having thus described a preferred embodiment of a grooved multi-stage depressed collector for secondary electron suppression, it should be apparent to those skilled in the art that certain advantages of the aforementioned system have been achieved. It should also be appreciated that various modifications, adaptations, and alternative embodiments thereof may be made within the scope and spirit of the present invention. The invention is further defined by the following claims.

What is claimed is:

1. A linear beam device, comprising:

a cathode and an anode spaced therefrom, said anode and said cathode being operable to form and accelerate an electron beam;

an RF interaction region having a drift tube adapted to permit said electron beam to pass therethrough; and a multi-stage depressed collector having a plurality of collector electrodes successively arranged to collect spent electrons of said electron beam after passing through said RF interaction region, each one of said plurality of collector electrodes having a distinct voltage level applied thereto defining a decelerating electric field within said collector, wherein at least one of said plurality of collector electrodes further comprises an electrode surface having a shape that is normal to a coincident trajectory of said spent electrons, said surface further having a portion thereof covered with a plurality of narrow grooves.

2. The linear beam device of claim 1, wherein said at least one of said plurality of collector electrodes further comprises a final one of said plurality of collector electrodes, and wherein said plurality of grooves are arranged in a concentric pattern of circles on said electrode surface.

3. The linear beam device of claim 2, wherein said shape of said electrode surface is substantially spherical.

4. The linear beam device of claim 1, wherein said plurality of grooves further comprise a depth that is greater than a corresponding width.

5. The linear beam device of claim 4, wherein said depth is at least twice said corresponding width.

6. The linear beam device of claim 1, wherein a region adjacent to an opening of each of said plurality of grooves comprises electric fields defining a convergent lens, thereby focusing said spent electrons into said plurality of grooves.

7. The linear beam device of claim 1, wherein said at least one of said plurality of collector electrodes further comprises an intermediate electrode other than a final collector electrode, and wherein said plurality of grooves are disposed on a side of said intermediate electrode oriented toward said cathode.

8. The linear beam device of claim 6, wherein said plurality of grooves of said at least one of said plurality of collector electrodes are arranged in a radial pattern.

9. The linear beam device of claim 1, wherein each one of said plurality of grooves has a substantially rectangular cross-section.

10. The linear beam device of claim 1, wherein each one of said plurality of grooves has a substantially triangular cross-section.

11. A multi-stage depressed collector for use with a linear beam device comprising a cathode and an anode spaced therefrom, said anode and said cathode being operable to form and accelerate an electron beam, and an RF interaction region having a drift tube adapted to permit said electron beam to pass therethrough, said collector comprising:

a plurality of collector electrodes successively arranged to decelerate and collect spent electrons of said electron beam after passing through said RF interaction region, each one of said collector electrodes having a distinct voltage levels applied thereto, wherein an ultimate one of said plurality of collector electrodes further comprises an electrode surface having a shape that is normal to a coincident trajectory of said spent electrons, said surface further having a substantial portion thereof covered with a plurality of narrow grooves.

12. The multi-stage depressed collector of claim 11, wherein said plurality of grooves are arranged in a concentric pattern of circles on said electrode surface.

13. The multi-stage depressed collector of claim 11, wherein said shape of said electrode surface is substantially spherical.

14. The multi-stage depressed collector of claim 11, wherein said plurality of grooves further comprise a depth that is greater than a corresponding width.

15. The multi-stage depressed collector of claim 14, wherein said depth is at least twice said corresponding width.

16. The multi-stage depressed collector of claim 11, wherein a region adjacent to an opening of each of said plurality of grooves comprises electric fields defining a convergent lens, thereby focusing said spent electrons into said plurality of grooves.

17. The multi-stage depressed collector of claim 11, wherein at least one of said plurality of collector electrodes other than said ultimate collector electrode further comprises a plurality of grooves disposed on a side thereof oriented toward said cathode.

18. The multi-stage depressed collector of claim 17, wherein said plurality of grooves of said at least one of said plurality of collector electrodes are arranged in a radial pattern.

19. The multi-stage depressed collector of claim 11, wherein each one of said plurality of grooves has a substantially rectangular cross-section.

20. The multi-stage depressed collector of claim 11, wherein each one of said plurality of grooves has a substantially triangular cross-section.

21. A method for improving the efficiency of a linear beam device having a cathode, an anode, and an RF interaction region, said anode and said cathode being operable to form and accelerate an electron beam that passes through said RF interaction region, said efficiency improving method comprising:

arranging a plurality of collector electrodes in succession to collect spent electrons of said electron beam after passing through said RF interaction region, said plurality of collector electrodes each further comprising a respective collecting surface having a shape that is normal to a coincident trajectory of said spent electrons;

applying a distinct voltage level to each of said plurality of collector electrodes to thereby define a decelerating electric field; and covering a substantial portion of said respective collecting surface of at least one of said plurality of collector electrodes with a plurality of narrow grooves.

22. The method of claim 21, wherein said covering step further comprises arranging said plurality of grooves in a concentric pattern of circles on said collecting surface.

23. The method of claim 21, wherein said covering step further comprises forming said plurality of grooves to a depth that is approximately twice a corresponding width.

24. The method of claim 21, wherein said covering step further comprises arranging said plurality of grooves in a radial pattern on said collecting surface.

25. The method of claim 21, wherein said covering step further comprises covering a substantial portion of said collecting surface of a final one of said plurality of collector electrodes with a plurality of narrow grooves.

26. The method of claim 21, wherein said covering step further comprises covering a substantial portion of said collecting surface of an intermediate one of said plurality of collector electrodes with a plurality of narrow grooves.

27. The method of claim 21, wherein said applying step further comprises defining a converging electric field region directly adjacent to respective openings into said plurality of grooves to thereby direct said spent electrons into said grooves.

* * * * *